US005740897A

United States Patent [19]

Gauselmann

[11] Patent Number: 5,740,897

[45] Date of Patent: Apr. 21, 1998

[54] DEVICE FOR THE REMOVAL OF A PAPER CURRENCY STACKER ASSOCIATED WITH A PAPER CURRENCY VALIDATOR DEVICE OF AN AUTOMATIC ENTERTAINMENT APPARATUS

[75] Inventor: Michael Gauselmann, Espelkamp, Germany

[73] Assignee: Atronic Casino Technology Distribution GmbH, Espelkamp, Germany

[21] Appl. No.: 531,501

[22] Filed: Sep. 21, 1995

[30] Foreign Application Priority Data

Sep. 23, 1994 [DE] Germany ..... 44 34 126.1

[51] Int. Cl.[6] ..... G07F 7/04

[52] U.S. Cl. ..... 194/206; 194/350

[58] Field of Search ..... 194/206, 207, 194/350

[56] References Cited

U.S. PATENT DOCUMENTS

| | | | |
|---|---|---|---|
| 740,385 | 11/1903 | Bassell . | |
| 3,655,186 | 4/1972 | Bayha | 271/88 |
| 4,127,328 | 11/1978 | Gorgone et al. | 356/71 |
| 4,563,771 | 1/1986 | Gorgone et al. | 382/7 |
| 4,752,142 | 6/1988 | Jackson et al. | 384/18 |
| 4,880,096 | 11/1989 | Kobayashi et al. | 194/206 |
| 5,113,990 | 5/1992 | Gabrius et al. | 194/206 |
| 5,292,192 | 3/1994 | Lautenschlager | 312/334.12 |
| 5,515,959 | 5/1996 | Stephenson et al. | 194/206 |

FOREIGN PATENT DOCUMENTS

| | | | |
|---|---|---|---|
| 2750652 | 11/1988 | Germany | G07D 7/00 |
| 41 21 985A1 | 7/1992 | Germany | G07F 17/32 |
| 40 39 396C2 | 3/1993 | Germany | G07D 1/00 |
| 2-210592 | 8/1990 | Japan | 194/206 |

OTHER PUBLICATIONS

"*Furniture Hardware*", Hettich International, Printer in Germany, 1993.

*Primary Examiner*—F. J. Bartuska
*Attorney, Agent, or Firm*—Horst M. Kasper

[57] ABSTRACT

A device for removing a paper currency stacker is furnished, where the paper currency stacker is connected to a paper currency validator at a coin-operated entertainment machine. The coin-operated entertainment machine includes a game device for representing winning or non-winning symbol combinations. In addition, a device of receiving coins and a further device for receiving bills are furnished in the front side area of the display windows of the entertainment machine. The invention device allows to withdraw a paper currency container through the front side of the entertainment machine. A part of the front side is formed as a front cover panel section for this purpose, where the front cover panel section is disposed on a guide rail system. A paper currency validator is placed behind the front cover panel section. A paper currency stacker with a paper currency container follows to the paper currency validator. The paper currency stacker is removably disposed at the paper currency validator.

35 Claims, 6 Drawing Sheets

DEVICE FOR THE REMOVAL OF A PAPER CURRENCY STACKER ASSOCIATED WITH A PAPER CURRENCY VALIDATOR DEVICE OF AN AUTOMATIC ENTERTAINMENT APPARATUS

BACKGROUND OF THE INVENTION

1. Field of the Invention

The invention relates to a device for the removal of a paper currency stacker which is coordinated to a paper currency validator of an automatic entertainment apparatus and, in particular, of a coin-operated automatic entertainment apparatus.

2. Brief Description of the Background of the Invention Including Prior Art

A paper currency insertion slot is disposed at the front side and next to rotating bodies of game machines employed in casinos. Following to the paper currency insertion slot, there is provided a paper currency validator connected to a respective paper currency stacker. The side wall of the casing of the gambling machines exhibits a lockable opening for allowing removal of the paper currency stacker. The removable paper currency stacker is disposed behind the lockable opening.

It is a disadvantage of such an arrangement that a minimum distance between adjacently positioned entertainment machines is required for allowing a removal of the paper currency stacker, where a supervising person removes the paper currency stacker from the side of the entertainment machine.

SUMMARY OF THE INVENTION

1. Purposes of the Invention

It is an object of the present invention to improve a coin-operated entertainment machine with a paper currency receiver such that the removal of a paper currency stacker becomes possible from the front side of the entertainment machine.

It is another object of the present invention to simplify the operation and maintenance of entertainment machines in order to allow maintenance and service operations to be performed from a single side of an entertainment machine.

It is a further object of the present invention to provide a reliable and safe collection space for paper currency in an entertainment machine, where the entertainment machine nevertheless is easily serviceable.

These and other objects and advantages of the present invention will become evident from the description which follows.

2. Brief Description of the Invention

The present invention provides for a paper currency accepting machine. A support structure formed by a side wall and a top cover attached to the side wall. A pair of rail sliders, extending substantially horizontally from a front of the paper currency accepting machine to a rear of the paper currency accepting machine, are attached to the support structure. A drawer framework is engaged with and runs on the rail sliders for allowing withdrawal of the drawer framework from the paper currency accepting machine. A front cover panel section is attached to the drawer framework for furnishing a substantially closed front side of the paper currency accepting machine when the drawer framework is in a recessed position. A paper currency insertion slot is furnished in the front cover panel section. A paper currency Validator is mounted to the drawer framework and disposed neighboring to the paper currency insertion slot for receiving paper currency inserted into the paper currency insertion slot. A paper currency stacker is disposed on the drawer framework and neighboring to the paper currency validator for receiving paper currency validated by the paper currency validator and for stacking such paper currency.

The drawer framework can be provided by a U-shaped bottom plate.

A first one of the rail sliders can be attached to the side wall and a second one of the rail sliders can be attached to the top cover.

Preferably, the paper currency stacker is removably attached to the paper currency validator.

The paper currency stacker can include two hinge pins aligned on a straight line at two opposite sides and near a top of the paper currency stacker. The paper currency validator can be furnished with two open slots near an upper side of the paper currency validator to be engaged by a respective one of the two hinge pins, such that the paper currency stacker is removably attached to the paper currency validator. Preferably, the two open slots have their open end disposed at the top of the open slot. The hinge pins of the paper currency stacker can engage the open slots by lowering the hinge pins from above into the open slots while the paper currency validator exhibits an angle of more than 10 degrees relative to an orthogonal position relative to the paper currency validator. The paper currency stacker can pivot around the hinge pins into a rest position next to and orthogonally to the paper currency validator.

The paper currency accepting machine can be an entertainment machine. A display of rotating reels can be disposed side by side relative to the front cover panel section.

A control panel can be disposed below the display of rotating reels. A coin insertion slot can be disposed below the front cover panel section.

An oblong slot can extend horizontally in the side wall. A lever can protrude through the oblong slot from the side wall of the paper currency accepting machine to an outer side of the side wall and can engage the drawer framework for initiating an opening of the drawer framework.

A lock closure cylinder can be attached to the side wall and can engage the drawer framework. A key matching the lock closure cylinder can be provided for locking the drawer framework in a closed position and for unlocking the drawer framework and for moving the drawer framework into an open position.

The invention apparatus is associated with the advantage that by using a pull-out guide rail system, where the paper currency validator and the following paper currency stacker are disposed like a front drawer on the guide rail system, the entertainment machines can be placed immediately next to each other without an intermediate space, and the paper currency stacker can be conveniently removed from the front side of the entertainment machine by the paper currency collecting agent.

There is no need to open the front side of the entertainment machine for the removal of the paper currency stacker. The gambling operation, when performed with coins, is not interrupted or influenced by a pulling out of the paper currency stacker.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF THE INVENTION AND PREFERRED EMBODIMENT

According to the present invention, there is provided for an apparatus for removing a paper currency stacker, which is associated to a paper currency validator at a coin-operated entertainment machine. The entertainment machine includes a game device representing a symbol combination. The paper currency validator is disposed neighboring to the game device representing a symbol combination. A paper currency stacker with a paper currency collection container is coordinated exchangeably to the paper currency validator. A region located at a front side neighboring to the game device or display windows 3*a*, 3*b*, 3*c* is formed as a front cover panel section 4. After a pulling out of the front cover panel section 4 with the paper currency validator 16 and the paper currency stacker 17, disposed behind the front cover panel section 4 of the entertainment machine, the paper currency stacker 17 is removable.

The front cover panel section 4 can be attached at a guide rail system 10. The guide rail system 10 can have captive guide rails formed as a push-roller guide. The guide rail system 10 can also have ball-bearing sliders formed as a ball-bearing slide.

The guide rail system 10 can comprise two telescopable rail sliders disposed parallel to each other and attached at a side wall of the entertainment apparatus.

Figure 1:
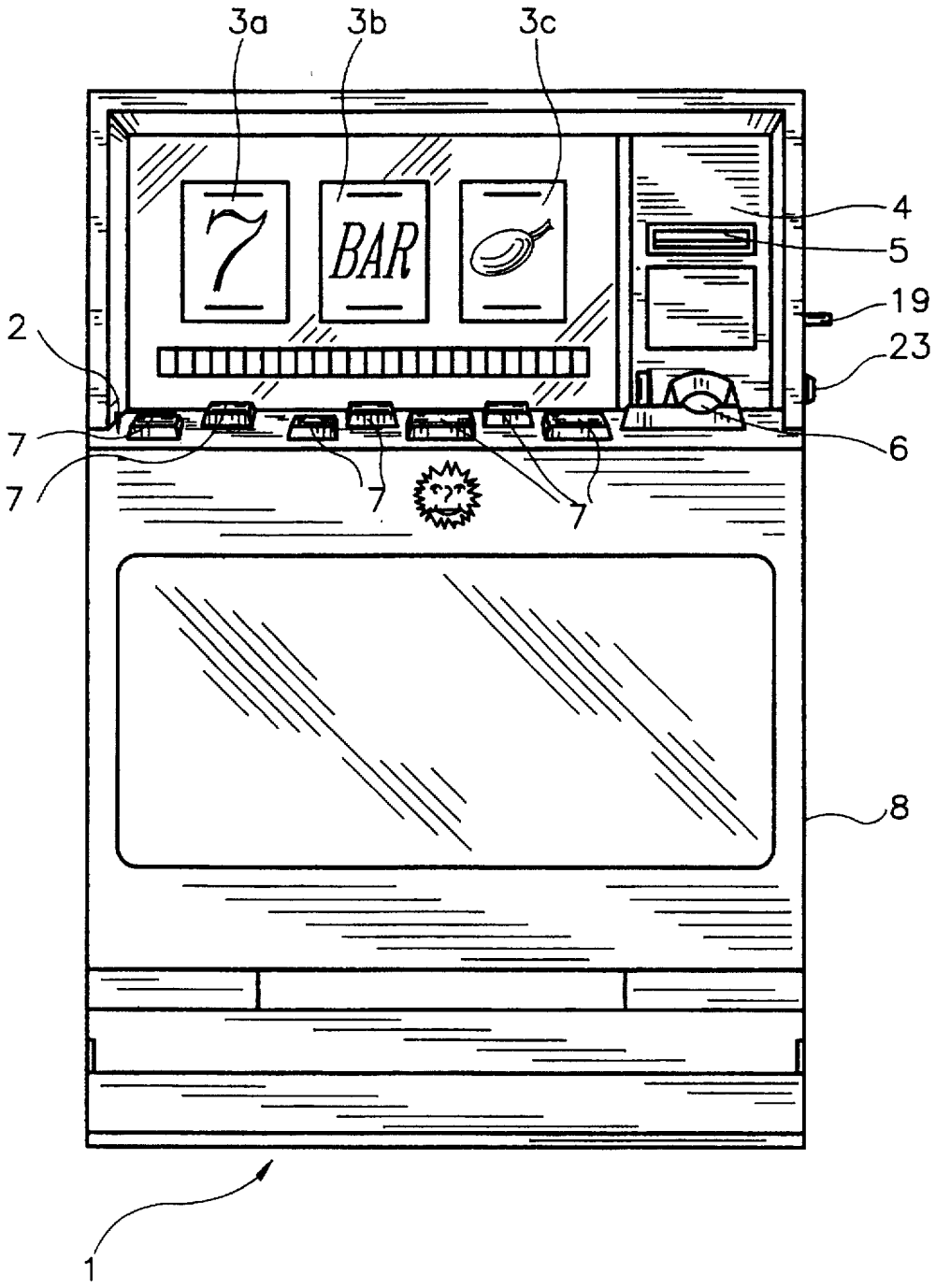
FIG. 1 is a front elevational view of an entertainment machine.

A coin-operated entertainment machine comprises an operating desk with a control panel 2 with buttons 7 or a keyboard 7 and is designated with reference numeral 1 in FIG. 1. A display of rotating reels, disposed side by side relative to the front cover panel section 4, is furnished by display windows 3*a*, 3*b*, 3*c*. The display windows 3*a*, 3*b*, 3*c* for viewing the process of the game and for viewing the game results are disposed next to each other above the control panel 2. Means for displaying game relevant symbols are furnished behind display windows 3*a*, 3*b*, 3*c*. The means for displaying game-relevant symbols are formed as rotating reels disposed in a casing 103 (FIG. 3) behind the display windows 3*a*, 3*b*, 3*c*. A symbol combination is displayed by the stopped reels, where a win or non-win situation is determined by the symbol combination according to a predetermined schedule. A front cover panel section 4 is disposed neighboring on the right-hand side relative to the position of the display window 3*c*. The front cover panel section 4 exhibits a slot-shaped opening or paper currency insertion slot 5. Entertainment machines including such features are known for example from U.S. application Ser. No. 08/401,937 filed by the assignee of the present application.

A paper currency validator 16 as well as a paper currency stacker 17 with a paper currency collection container are disposed behind the paper currency insertion slot 5. The paper currency stacker 17 can, if desired, perform itself the function of the paper currency collection container. A coin-insertion slot 6 is furnished on the control panel 2 below the paper currency insertion slot 5. The presence of both a paper currency insertion slot 5 and of a coin-insertion slot 6 allows to operate the present entertainment machine both with coins and paper currency. However, in certain situations a coin operation will not be feasible or possible and in such cases a respective entertainment machine will not exhibit a coin-insertion slot 6.

Furthermore, actuating elements or keys 7 are disposed on the control panel 2 and possibly associated with and coordinated to a respective display window 3*a*, 3*b*, 3*c*.

Figure 2:
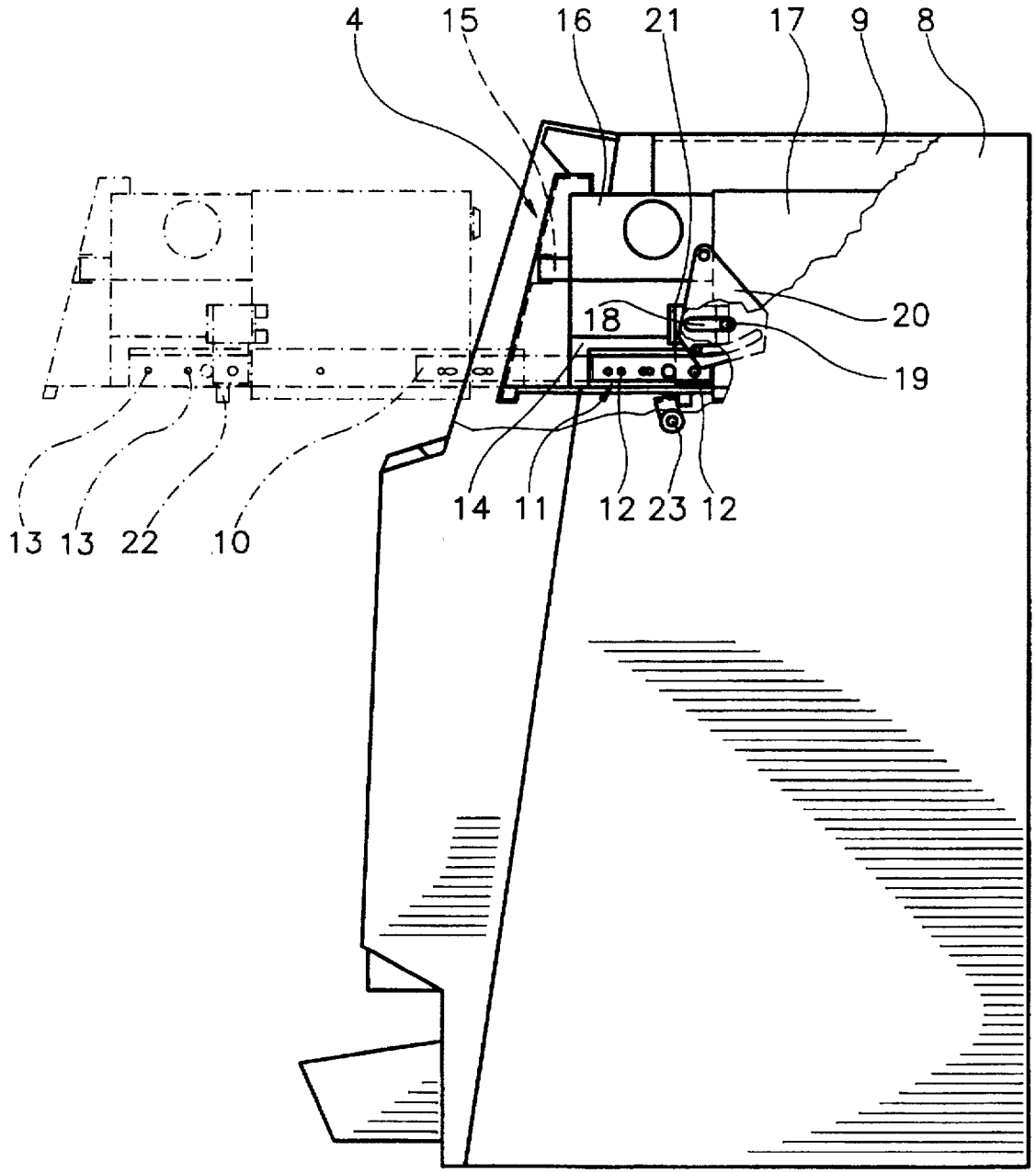
FIG. 2 is a side elevational view of an entertainment machine with a paper currency validator and a paper currency stacker, where the pulled-out position of the paper currency stacker is indicated by dash-dotted lines.
Figure 5:
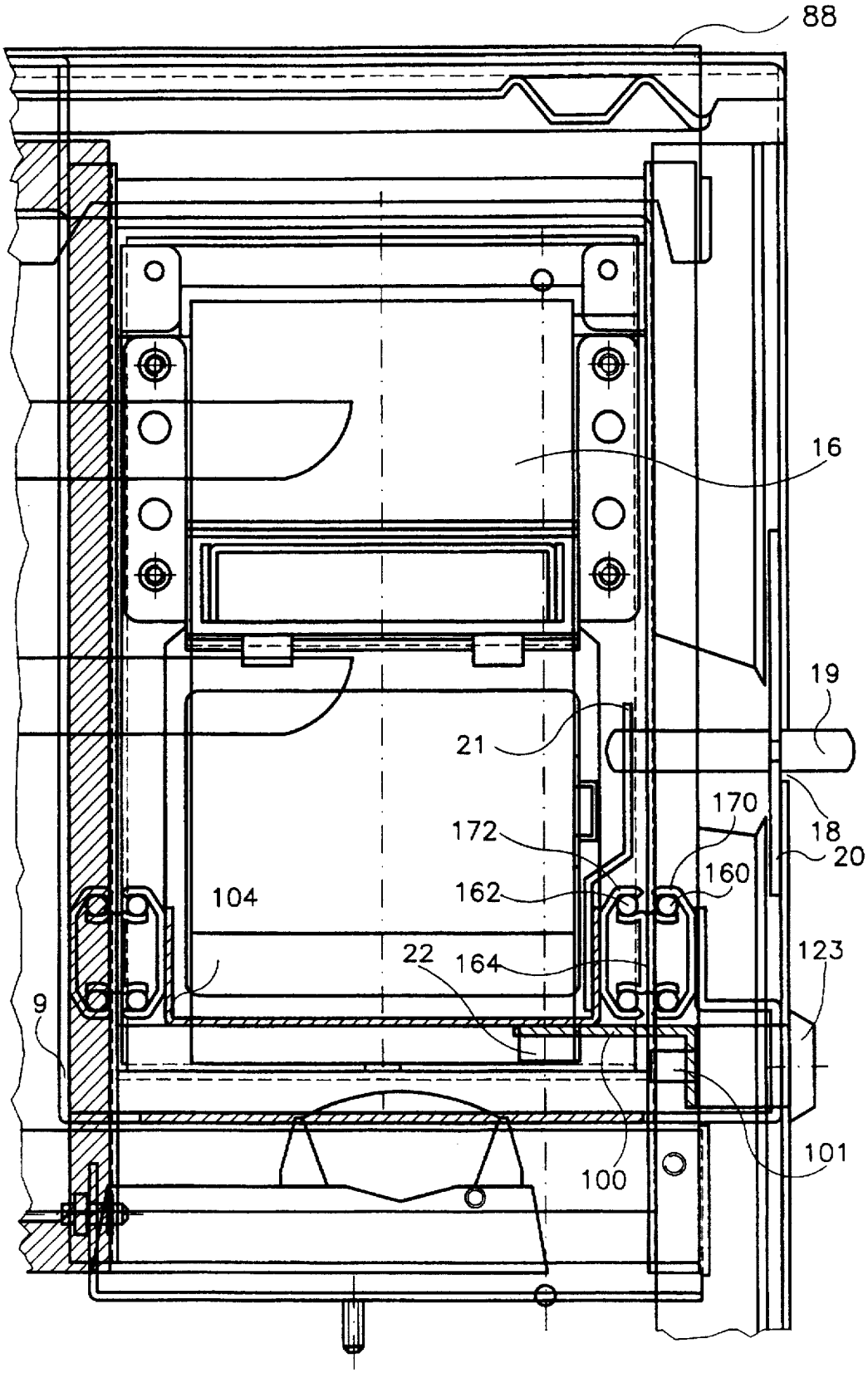
FIG. 5 is a cross-sectional view of the entertainment machine of FIG. 1 in the area of the lock closure cylinder.

The entertainment machine 1 is illustrated in a side elevational view with a partially broken-out side wall 8 in FIG. 2. Rail sliders 10 for pull-out drawer operation and shaped as guide rails, push-roller guides, captive-guide rails or ball-bearing pullout slides are furnished at and attached to the side wall 8 as well as to a support guide plate 9 attached to and disposed on the side of the top cover 88 and directed towards the bottom plate. The plane of the side wall 8 and of the support guide plate 9 is vertically positioned. The support guide plate 9 (FIG. 5) is attached to the top cover 88 of the entertainment machine 1 and the support guide plate 9 is directed to a U-shaped bottom plate 14 of the entertainment machine 1. The side wall 8 and the top cover 88 attached to said side wall form a support structure for the rail sliders 10. The rail sliders 10 are furnished as a push-roller guide or as ball-bearing pullouts. The rail sliders 10 can be provided as commercially available from Hettich America, Inc., Harrisonville and described in catalogue KB/WS 01,024.07.01 issued 1993. This catalogue contains push-roller guides, where a captive guide rail compensates application tolerances and, at the same time, provides parallel guidance over the total length of the drawer extension. The rollers 160 are mounted to the side wall 8 and the support guide plate 9, and the rail sliders 170 are provided at the drawer with profiles matching the rollers 160. U.S. Pat. No. 5,292,192 to Lautenschläger teaches a guide rail for roller drawer guides useful in the context of the present invention. The above recited catalogue further provides ball bearing slides, where an outer rail is running through cages with balls on an inner rail. U.S. Pat. No. 4,752,142 to Jackson et al. teaches a ball slide system, where an inner runner runs on three sets of balls within an outer runner. FIG. 5 of the present application shows rollers 160, 162, a ball bearing cage 164, and rail sliders 170, 172 of a ball bearing slide.

A drawer framework 110 (FIG. 4) is defined by a front cover panel section 4 attached to the U-shaped bottom plate 14 protruding into the casing of the entertainment machine when in operating position. The rail sliders 10, 172 (FIG. 5) attached to the drawer framework 110 exhibit threaded tapholes 12 (FIG. 2) in the front region 11, where the threaded tapholes 12 correspond in their position to break-outs 13 of the U-shaped bottom-plate 14. The bottom plate 14 is form-lockingly attached to the rail sliders 10. A feed rail 15 of the paper currency validator 16 protrudes into the paper currency insertion slot 5 of the front cover panel section 4.

Figure 4:
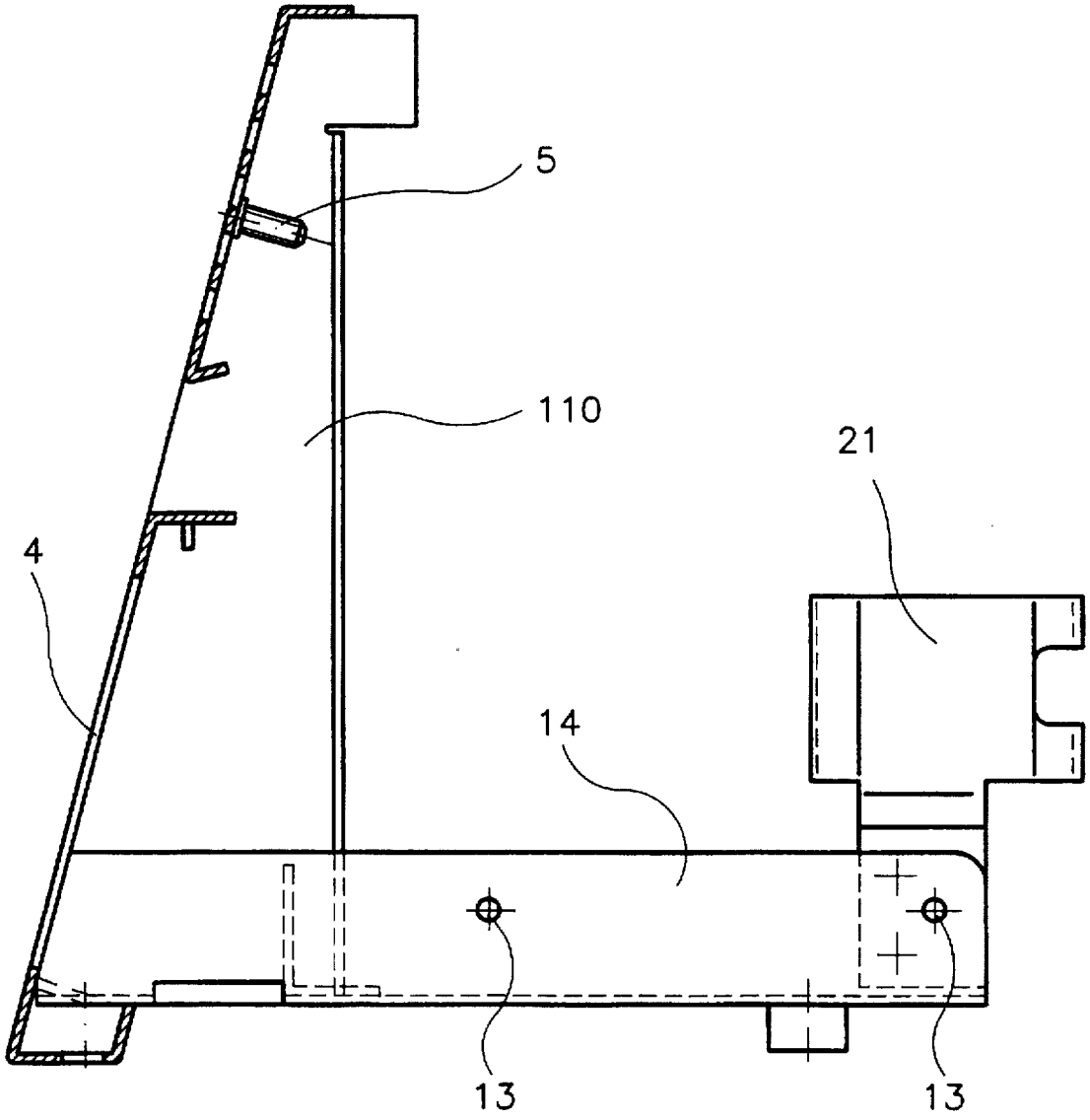
FIG. 4 is a sectional view of a schematic diagram illustrating the attachment of the paper currency validator to the drawer framework.

The paper currency validator 16 can be of the type 150A-Y-6-24VDC-0-0-U.S.A., part number 100-C-1002-1 commercially available from Coin Bill Validator Inc., 367B Bayshore Road, Deer Park, N.Y. 11729. Such paper currency validators can be constructed based on principles described for example in U.S. Pat. No. 4,563,771 to Gorgone et al. for an audible security validator. The general construction of a paper currency validator is taught for example in German Printed Patent Document DE-OS 27 50 652 to Ardac, which document makes reference to U.S. patent application Ser. No. 740,385 of Nov. 10, 1976 now U.S. Pat. No. 4,127,328. The paper currency validator 16 is furnished with electrical contacts or wires for receiving electrical power for operation. In particular, a socket with an electrical contact can be provided on the side of the paper currency validator 16. A low-voltage plug 116 can be provided on the feed cable 126 for connecting to the socket. The paper currency validator 16 is attached to the front cover panel section 4 as shown in FIG. 4.

A paper currency stacker 17 with a removable paper currency collection container is disposed on the rear side of and behind the paper currency validator 16. The paper currency stacker 17 can be of the type part number 102-D-0413-1 commercially available from Coin Bill Validator Inc., 367B Bayshore Road, Deer Park, N.Y. 11729. Such paper currency stackers can be constructed based on the principles described for example in U.S. Pat. No. 3,655,186 to Bayha for a stacker for paper currency. The paper currency stacker 17 is shape-matchingly and form-lockingly attached to the paper currency validator 16. The paper currency stacker 17 is furnished with electrical contacts in a socket, where a plug 117 attached to a feed cable 127 engages the socket for delivering electrical power for operation of the paper currency stacker 17. The paper currency stacker 17 is furnished on its rear wall 147 (FIG. 6) with a closable opening and the paper currency in the paper currency collection container can be removed through the closable opening. A paper currency feed chamber is located above the paper currency collection container. The paper currency accepted and validated by the paper currency validator 16 are fed to the paper currency feed chamber. A drive of the paper currency stacker 17 and a deflectable stamp are disposed above the paper currency feed chamber. The deflectable stamp passes through the paper currency feed chamber and presses an individual paper currency piece into the paper currency collection container disposed below the paper currency feed chamber.

The side wall 8 of the entertainment machine exhibits an oblong slot 18 in the region of the paper currency validator 16 above the rail sliders 10. A lever 19 protrudes through this oblong slot 18. The lever 19 is attached to a tiltable support plate piece 20 made of sheet metal, where the tiltable support plate piece 20 is rotatably supported on the side of the casing. Otherwise, the lever 19 protrudes against a stop 21, where the stop 21 is attached at the bottom plate 14 of the front part region. Furthermore, the bottom plate 14 includes a lock stop 22, where a blocking angle 100, made of sheet metal, is associated with a lock closure cylinder 23 and presses against the lock stop 22. The blocking angle 100 is tilted from the locking rest position by activation of the lock closure cylinder 23. By a forward-pulling of the lever 19, protruding to the outside of the entertainment machine 1, a further part of the lever 19 is pressed against the stop 21 of the rail slider. The front cover panel section 4 is deflected and moved forwardly together with the paper currency validator 16 and the paper currency stacker 17, disposed behind the front cover panel section 4, such that it is now possible to grip behind the front cover panel section 4 in the upper region of the front cover panel section 4 and the drawer framework 110 (FIG. 4) can be fully pulled out. The filled paper currency collection container located in the paper currency stacker 17 on the drawer framework 110 can be removed in this position of the drawer framework 110 and can be replaced by another empty paper currency collection container. In addition, it is possible in this position of the drawer framework 110 to remove the paper currency validator 16 and/or the paper currency stacker 17, for example, for servicing or exchange purposes. Thus, it is sufficient for servicing the section of the entertainment machine involved with paper currency to pull the drawer framework 110 out and an opening of a side of the entertainment machine, formed as a door, is not necessary. In addition, the game operation can be continued with coins while the paper currency collection container is removed and exchanged. After the exchange of the paper currency collection container, the drawer framework 110 is slid into the entertainment machine 1. The locking of the drawer framework 110 is performed by activating the lock closure cylinder 23.

Figure 3:
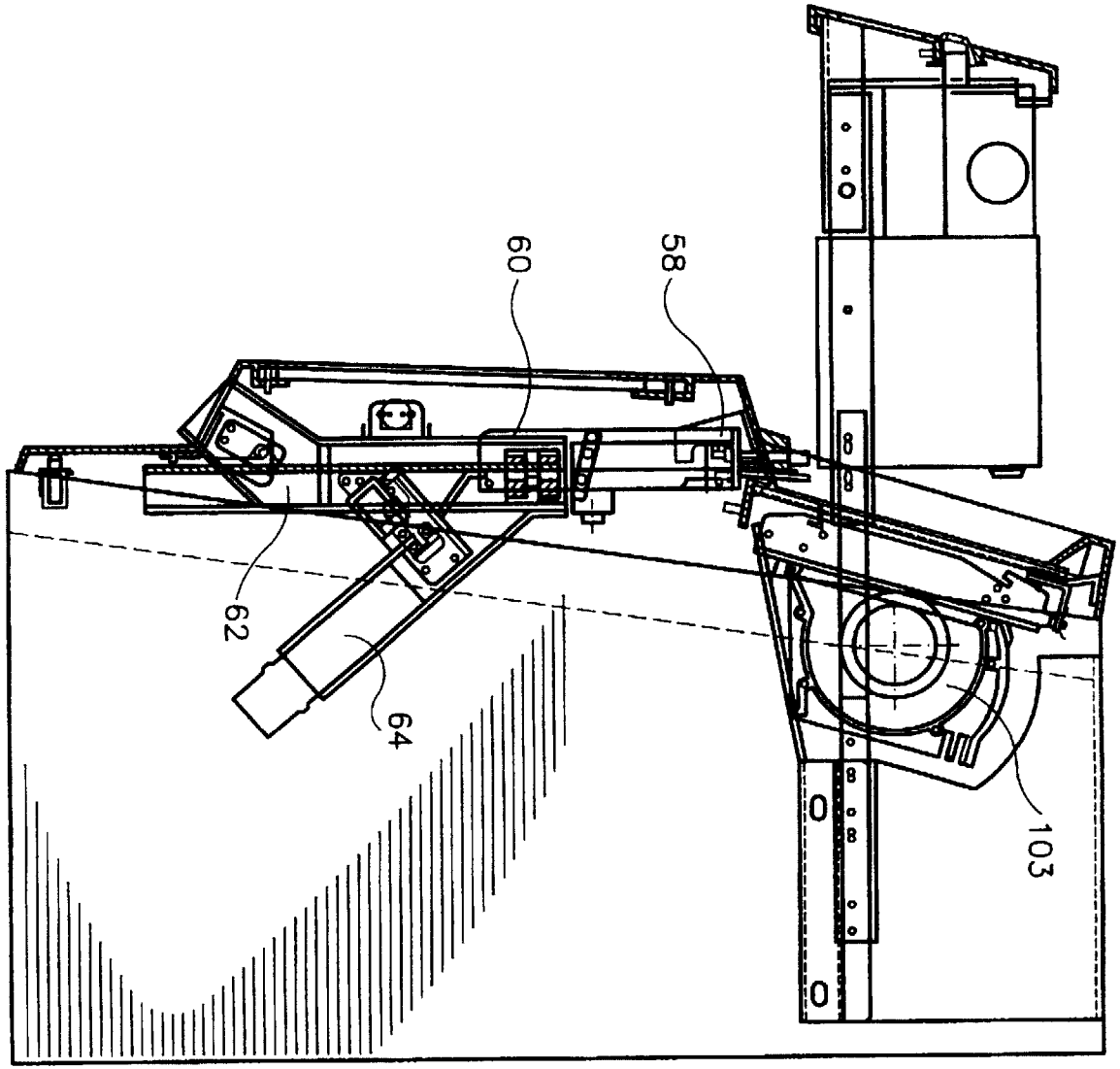
FIG. 3 is a schematic diagram showing the entertainment machine of FIG. 2 together with a coin acceptance unit.

FIG. 3 illustrates schematically the presence of a coin acceptance unit 58 associated with the coin-insertion slot 6. The coin acceptance unit 58 is furnished on the inclined door region below the symbol game device or below the drawer framework 110. The coin-insertion slot 6 is disposed such that the front cover panel section 4 can be pulled out without interfering with the coin-insertion slot 6. A mechanical coin tester 60 is connected to the coin acceptance unit 58. A coin channel 62 then leads from the coin tester 60 to a coin removal tub disposed in the lower region of the front side of the entertainment machine 1 for returning coins not accepted. A second coin channel 64 disposed below the coin tester 60 guides the received and accepted coins into a coin collection container disposed in the lower part of the entertainment machine 1.

FIG. 4 shows in detail the features of the drawer framework 110 for attaching the paper currency validator 16. The U-shaped bottom plate 14, 104 supports the rail sliders 172 of a push roller guide or of a ball bearing slide. The breakouts 13 for attaching the rail sliders 172 are shown in the U-shaped bottom plate 14, 104 (FIG. 4).

FIG. 5 shows a cross-section through the entertainment machine 1 in the area of the lock closure cylinder 23. The lock closure cylinder 23 exhibits on its rear side a closure pin 101. A key 123 is provided for actuating the lock closure cylinder 23. A blocking angle 100 is force-matchingly or form-matchingly attached to the closure pin 101. The blocking angle 100 presses against the lock stop 22 while the paper currency validator 16 is in operating position. The lock closure cylinder 23 penetrates a breakout in the side wall 8 and exhibits a collar on the one side and on the other side a thread at the outer periphery of the lock closure cylinder 23 for accepting a threaded nut. The side wall 8 is fixedly attached between the collar and the threaded nut.

The closure pin 101 can be actuated in counter-clockwise direction with the key 123 belonging to the lock closure cylinder 23. This actuation lowers the blocking angle 100 to such an extent that the blocking angle 100 releases the lock stop 22, and the paper currency validator 16 can be slid by actuation of the lever 19 into the opened position illustrated with dash-dotted lines in FIG. 2.

Figure 6:
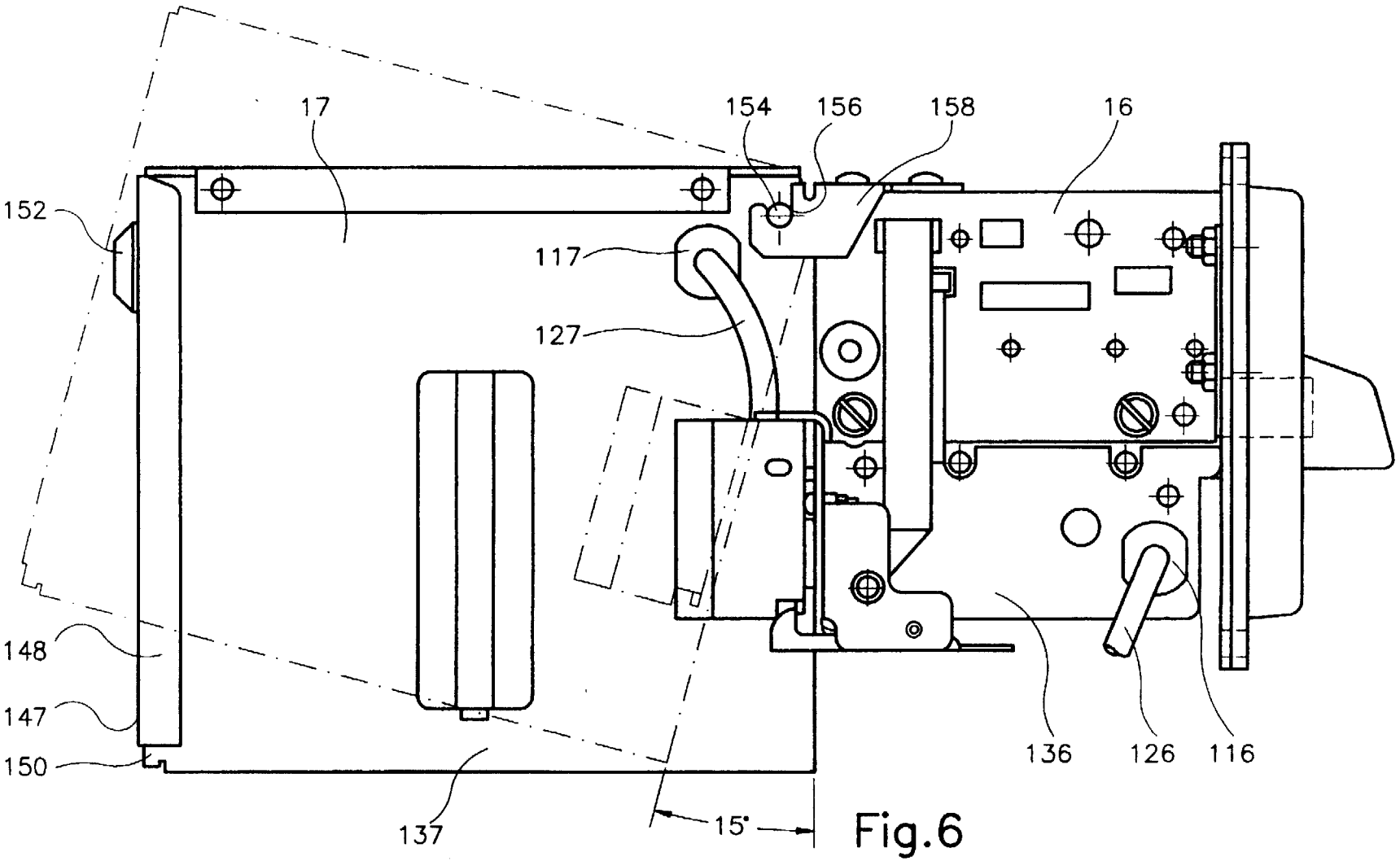
FIG. 6 is a side elevational view of a paper currency validator and of an associated paper currency stacker.

FIG. 6 shows a side elevational view on a paper currency validator 16 and a paper currency stacker 17. The paper currency validator 16 is furnished with a socket with electrical contacts on a side wall 136 for receiving a plug 116 connected to a feed cable 126. The paper currency stacker 17 is furnished with a socket with electrical contacts on a side wall 137 aligned with the side wall of the paper currency validator 16 for receiving a plug 117 connected to a feed cable 127. The rear wall 147 of the paper currency stacker 17 is furnished with a door 148 hinged at a bottom edge 150 and swinging open around the hinged bottom edge 150. A lock 152 is attached to the door 148 for maintaining the paper currency collection container in a locked position while the paper currency stacker 17 is removed from the entertainment machine 1. The paper currency stacker 17 contains a spring preferably mounted to a bottom part of the paper currency stacker 17 for pressing a horizontally disposed plate upwardly against the paper currency placed into the paper currency stacker 17. A drive for a stamp for positioning the paper currency piece in the paper currency stacker 17 is provided near a top wall of the paper currency stacker 17.

Hinge pins 154 are provided on two opposite sides of the paper currency stacker 17 for allowing to hang the paper currency stacker 17 into corresponding open slots 156 present in two parallel plates 158 attached to the paper currency validator 16. In this way, the paper currency stacker 17 can easily be form-matchingly positioned at the paper currency validator 16 for receiving paper currency pieces after validation by the paper currency validator 16. The paper currency stacker 17 is pivoted around the hinge pins 154 such that, first, an alignment of the hinge pins 154 with the open slots 156 can be accomplished and then the paper currency stacker 17 is lowered at its other end until it reaches a proper position relative to the paper currency validator 16, where an orthogonal alignment of the paper currency stacker 17 is reached relative to the position of the paper currency validator 16. The construction of the paper currency stacker 17 is preferably such that a removal of the paper currency stacker 17 from the paper currency validator 16 is only possible after a rotation of the paper currency stacker by a certain angle of, for example, 15 degrees has occurred around the hinge pins 154 relative to the paper currency validator 16.

It will be understood that each of the elements described above, or two or more together, may also find a useful application in other types of system configurations and paper currency processing procedures differing from the types described above.

While the invention has been illustrated and described as embodied in the context of a device for a removal of a paper currency stacker from an entertainment machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A paper currency accepting machine comprising a support structure formed by a side wall and a top cover attached to the side wall;

a pair of rail sliders extending substantially horizontally from a front of the paper currency accepting machine to a rear of the paper currency accepting machine and attached to the support structure;

a drawer framework engaged with and running on the rail sliders for allowing withdrawal of the drawer framework from the paper currency accepting machine;

a front cover panel section attached to the drawer framework for furnishing a substantially closed front side of the paper currency accepting machine when the drawer framework is in a recessed position;

a paper currency insertion slot furnished in the front cover panel section;

a paper currency validator mounted to the drawer framework and disposed neighboring to the paper currency insertion slot for receiving paper currency inserted into the paper currency insertion slot;

a paper currency stacker disposed on the drawer framework and neighboring to the paper currency validator for receiving paper currency validated by the paper currency validator and for stacking such paper currency;

a horizontally extending oblong slot in the side wall;

a lever protruding through the oblong slot from the side wall of the paper currency accepting machine to an outer side of the side wall and capable of engaging the drawer framework for initiating an opening of the drawer framework.

2. The paper currency accepting machine according to claim 1, wherein the drawer framework is provided by a U-shaped bottom plate.

3. The paper currency accepting machine according to claim 1, wherein a first one of the rail sliders is attached to the side wall, and wherein a second one of the rail sliders is attached to the top cover.

4. The paper currency accepting machine according to claim 1, wherein the paper currency stacker is removably attached to the paper currency validator.

5. The paper currency accepting machine according to claim 1, wherein the paper currency stacker includes two hinge pins aligned on a straight line at two opposite sides and near a top of the paper currency stacker, wherein the paper currency validator is furnished with two open slots near an upper side of the paper currency validator to be engaged by a respective one of the two hinge pins, such that the paper currency stacker is removably attached to the paper currency validator.

6. The paper currency accepting machine according to claim 5, wherein the two open slots have their open end disposed at the top of the open slot, wherein the hinge pins of the paper currency stacker engage the open slots by lowering the hinge pins from above into the open slots while the paper currency validator exhibits an angle of more than 10 degrees relative to an orthogonal position relative to the paper currency validator, and wherein the paper currency stacker pivots around the hinge pins into a rest position next to and orthogonally to the paper currency validator.

7. The paper currency accepting machine according to claim 1, wherein the paper currency accepting machine is an entertainment machine, further comprising a display of rotating reels disposed side by side relative to the front cover panel section.

8. The paper currency accepting machine according to claim 7, further comprising a control panel disposed below the display of rotating reels;

a coin insertion slot disposed below the front cover panel section.

9. The paper currency accepting machine according to claim 1, further comprising a lock closure cylinder attached to the side wall and capable of engaging the drawer framework;

a key matching the lock closure cylinder for locking the drawer framework in a closed position and for unlocking the drawer framework and for moving the drawer framework into an open position.

10. Apparatus for removing a paper currency stacker, which is associated to a paper currency validator at a coin-operated entertainment machine comprising a guide rail system (10) disposed at a casing of the coin-operated entertainment machine;

a front cover panel section (4) attached at the guide rail system (10);

a paper currency validator (16) disposed behind the front cover panel section (4); and a paper currency stacker (17) disposed on a rear side of and behind the paper currency validator (16), wherein after a pulling out of the front cover panel section (4) having attached a drawer framework carrying the paper currency validator (16) and a paper currency stacker (17), disposed behind the front cover panel section (4) of the entertainment machine, the paper currency stacker (17) is removable;

a horizontally extending oblong slot in a side wall of the paper currency accepting machine;

a lever protruding through the oblong slot from the side wall of the paper currency accepting machine to an outer side of the side wall and capable of engaging the drawer framework for initiating an opening of the drawer framework.

11. The apparatus according to claim 10, wherein the guide rail system (10) has captive guide rails formed as a push-roller guide.

12. The apparatus according to claim 10, wherein the guide rail system (10) has ball-bearing sliders formed as a ball-bearing slide.

13. Apparatus according to claim 11, wherein the guide rail system (10) comprises two telescopable rail sliders disposed parallel to each other and attached at a side wall of the entertainment apparatus.

14. Apparatus according to claim 12, wherein the guide rail system (10) comprises two telescopable rail sliders disposed parallel to each other and attached at a side wall of the entertainment apparatus.

15. A paper currency accepting machine comprising a support structure formed by a side wall and a top cover attached to the side wall;

a pair of rail sliders extending substantially horizontally from a front of the paper currency accepting machine to a rear of the paper currency accepting machine and attached to the support structure;

a drawer framework engaged with and running on the rail sliders for allowing withdrawal of the drawer framework from the paper currency accepting machine;

a front cover panel section attached to the drawer framework for furnishing a substantially closed front side of the paper currency accepting machine when the drawer framework is in a recessed position;

a paper currency insertion slot furnished in the front cover panel section;

a paper currency validator mounted to the drawer framework and disposed neighboring to the paper currency insertion slot for receiving paper currency inserted into the paper currency insertion slot;

a paper currency stacker disposed on the drawer framework and neighboring to the paper currency validator for receiving paper currency validated by the paper currency validator and for stacking such paper currency;

a second pair of rail sliders extending substantially horizontally and attached to the drawer framework and engaged with the rail sliders attached to the structure by means of a ball bearing slide.

16. The paper currency accepting machine according to claim 15, wherein the paper currency stacker is removably attached to the paper currency validator.

17. The paper currency accepting machine according to claim 15, wherein the paper currency accepting machine is an entertainment machine, further comprising a display of rotating reels disposed side by side relative to the front cover panel section.

18. The paper currency accepting machine according to claim 17, further comprising a control panel disposed below the display of rotating reels;

a coin insertion slot disposed below the front cover panel section.

19. A paper currency accepting machine comprising a support structure formed by a side wall and a top cover attached to the side wall;

a pair of rail sliders extending substantially horizontally from a front of the paper currency accepting machine to a rear of the paper currency accepting machine and attached to the support structure;

a drawer framework engaged with and running on the rail sliders for allowing withdrawal of the drawer framework from the paper currency accepting machine;

a front cover panel section attached to the drawer framework for furnishing a substantially closed front side of the paper currency accepting machine when the drawer framework is in a recessed position;

a paper currency insertion slot furnished in the front cover panel section;

a paper currency validator mounted to the drawer framework and disposed neighboring to the paper currency insertion slot for receiving paper currency inserted into the paper currency insertion slot;

a paper currency stacker disposed on the drawer framework and neighboring to the paper currency validator for receiving paper currency validated by the paper currency validator and for stacking such paper currency;

a lock closure cylinder mounted to the side wall for being actuated by a key from the outside of the side wall;

a closure pin mounted to a rear side of the lock closure cylinder;

a lock stop associated with the paper currency validator;

a blocking angle attached to the closure pin and pressing against the lock stop while the paper currency validator is in an operating position.

20. The paper currency accepting machine according to claim 19, further comprising a breakout formed in the side wall penetrated by the lock closure cylinder;

a collar disposed on a first side of the lock closure cylinder;

a thread disposed at an outer periphery of the lock closure cylinder and on a second side of the lock closure cylinder for accepting a threaded nut, wherein the side wall is fixedly placed between the collar and the threaded nut.

21. A paper currency accepting machine according to claim 17, further comprising a first plate attached to the paper currency validator and having a first open slot;

a second plate disposed parallel to the first plate and attached to the paper currency validator and having a second open slot;

hinge pins disposed on two opposite sides of the paper currency stacker for allowing to hang the paper currency stacker into the first open slot and into the second open slot such that the paper currency stacker can easily be form-matchingly positioned at the paper currency validator for receiving paper currency pieces after validation by the paper currency validator and such that the paper currency stacker pivots around the hinge pins providing that, first, an alignment of the hinge pins with the first open slot and, respectively, the second open slot can be accomplished, and wherein thereupon the paper currency stacker can be lowered at its other end until it reaches a proper position relative to the paper currency validator, wherein an orthogonal alignment of the paper currency stacker is reached relative to a position of the paper currency validator.

22. The paper currency accepting machine according to claim 19, wherein the paper currency stacker is removably attached to the paper currency validator.

23. The paper currency accepting machine according to claim 19, wherein the paper currency accepting machine is an entertainment machine, further comprising a display of rotating reels disposed side by side relative to the front cover panel section.

24. The paper currency accepting machine according to claim 23, further comprising a control panel disposed below the display of rotating reels;

a coin insertion slot disposed below the front cover panel section.

25. The paper currency accepting machine according to claim 21, wherein the paper currency stacker is removably attached to the paper currency validator.

26. The paper currency accepting machine according to claim 21, wherein the paper currency accepting machine is an entertainment machine, further comprising a display of rotating reels disposed side by side relative to the front cover panel section.

27. The paper currency accepting machine according to claim 26, further comprising a control panel disposed below the display of rotating reels;

a coin insertion slot disposed below the front cover panel section.

28. A paper currency accepting machine comprising a support structure formed by a side wall and a top cover attached to the side wall;

a pair of rail sliders extending substantially horizontally from a front of the paper currency accepting machine to a rear of the paper currency accepting machine and attached to the support structure;

a drawer framework engaged with and running on the rail sliders for allowing withdrawal of the drawer framework from the paper currency accepting machine;

a front cover panel section attached to the drawer framework for furnishing a substantially closed front side of the paper currency accepting machine when the drawer framework is in a recessed position;

a paper currency insertion slot furnished in the front cover panel section;

a paper currency validator mounted to the drawer framework and disposed neighboring to the paper currency insertion slot for receiving paper currency inserted into the paper currency insertion slot;

a paper currency stacker disposed on the drawer framework and neighboring to the paper currency validator for receiving paper currency validated by the paper currency validator and for stacking such paper currency;

a side wall of the paper currency validator;

a first socket having electrical contacts disposed on the side wall on the paper currency validator for receiving a plug connected to a feed cable;

a second socket with electrical contacts disposed on the side wall of the paper currency stacker aligned with the side wall of the paper currency validator for receiving a second plug connected to a second feed cable.

29. The paper currency accepting machine according to claim 28, wherein the paper currency stacker is removably attached to the paper currency validator.

30. The paper currency accepting machine according to claim 28, wherein the paper currency accepting machine is an entertainment machine, further comprising a display of rotating reels disposed side by side relative to the front cover panel section.

31. The paper currency accepting machine according to claim 30, further comprising a control panel disposed below the display of rotating reels;

a coin insertion slot disposed below the front cover panel section.

32. A paper currency accepting machine comprising a support structure formed by a side wall and a top cover attached to the side wall;

a pair of rail sliders extending substantially horizontally from a front of the paper currency accepting machine to a rear of the paper currency accepting machine and attached to the support structure;

a drawer framework engaged with and running on the rail sliders for allowing withdrawal of the drawer framework from the paper currency accepting machine;

a front cover panel section attached to the drawer framework for furnishing a substantially closed front side of the paper currency accepting machine when the drawer framework is in a recessed position;

a paper currency insertion slot furnished in the front cover panel section;

a paper currency validator mounted to the drawer framework and disposed neighboring to the paper currency insertion slot for receiving paper currency inserted into the paper currency insertion slot;

a paper currency stacker disposed on the drawer framework and neighboring to the paper currency validator for receiving paper currency validated by the paper currency validator and for stacking such paper currency;

a door hinged at a bottom edge of the paper currency stacker and swinging open around the hinged bottom edge of the paper currency stacker and located at a rear wall of the paper currency stacker;

a lock attached to the door for maintaining a paper currency collection container in a locked position while the paper currency stacker is removed from the entertainment machine;

a horizontally disposed plate located in the paper currency stacker;

a spring contained in the paper currency stacker and mounted to a bottom part of the paper currency stacker for pressing the horizontally disposed plate upwardly against paper currency placed into the paper currency stacker;

a drive for a stamp for positioning a piece of paper currency in the paper currency stacker and located near a top wall of the paper currency stacker.

33. The paper currency accepting machine according to claim 32, wherein the paper currency stacker is removably attached to the paper currency validator.

34. The paper currency accepting machine according to claim 32, wherein the paper currency accepting machine is an entertainment machine, further comprising a display of rotating reels disposed side by side relative to the front cover panel section.

35. The paper currency accepting machine according to claim 34, further comprising a control panel disposed below the display of rotating reels;

a coin insertion slot disposed below the front cover panel section.

* * * * *